United States Patent [19]

Cassia

[11] 4,345,627

[45] Aug. 24, 1982

[54] SOAP DISPENSING SYSTEM

[75] Inventor: Antonio M. Cassia, Milan, Italy

[73] Assignee: Steiner Corporation, Salt Lake City, Utah

[21] Appl. No.: 150,556

[22] Filed: May 16, 1980

[30] Foreign Application Priority Data

Jan. 21, 1980 [IT] Italy ..... 19346 A/80

[51] Int. Cl.[3] ..... B65B 3/04

[52] U.S. Cl. ..... 141/18; 141/364; 222/325

[58] Field of Search ..... 222/325, 81, 82; 141/19, 329, 330, 18, 114, 286, 346, 347, 351, 352, 364; 206/222

[56] References Cited

U.S. PATENT DOCUMENTS

| | | | |
|---|---|---|---|
| 3,405,844 | 10/1968 | Lenz et al. | 222/325 |
| 3,459,343 | 8/1969 | Rasmussen | 222/325 |
| 3,482,258 | 12/1969 | Steen | 222/80 |
| 3,952,918 | 4/1976 | Poitras et al. | 222/82 |
| 4,018,363 | 4/1977 | Cassia | 222/325 |
| 4,149,573 | 4/1979 | Cassia . | |
| 4,164,306 | 8/1979 | Perrin | 222/325 |
| 4,173,858 | 11/1979 | Cassia . | |
| 4,238,056 | 12/1980 | Tucker et al. | 222/325 |

*Primary Examiner*—Frederick R. Schmidt

*Attorney, Agent, or Firm*—Dithmar, Stotland, Stratman & Levy

[57] ABSTRACT

A liquid soap dispensing system includes a closed soap container having a manually actuated dispensing pump carried therebeneath, the container being separated by a partition into a lower soap reservoir and an upper refill compartment, the latter adapted to enclose therein a removable refill cartridge. The cartridge has an outlet neck closed by a pierceable membrane recessed therein and adapted to be received into a well in the partition in surrounding relationship with a hollow tubular piercing member which pierces the membrane and is dimensioned to accommodate free flow of liquid soap therethrough from the cartridge to the reservoir. The cartridge is semirigid and has guide surfaces engageable with positioning members in the refill compartment for guiding and positioning the cartridge therein. A twist-off cap opens a vent aperture in the cartridge while a vent tube vents the reservoir. A slot in the wall of the refill compartment prevents the accumulation of free liquid soap therein.

33 Claims, 8 Drawing Figures

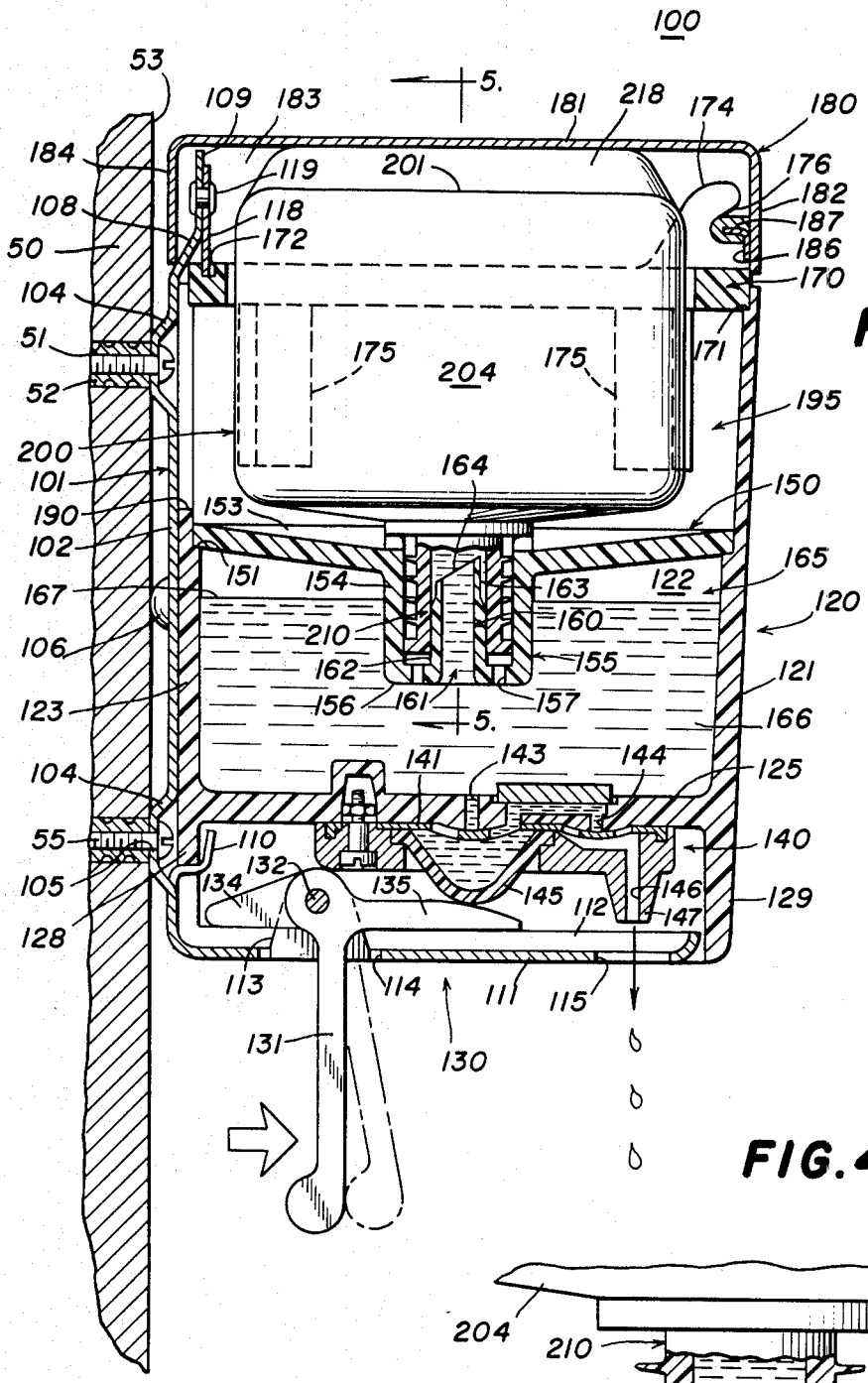
FIG. 3
FIG. 4
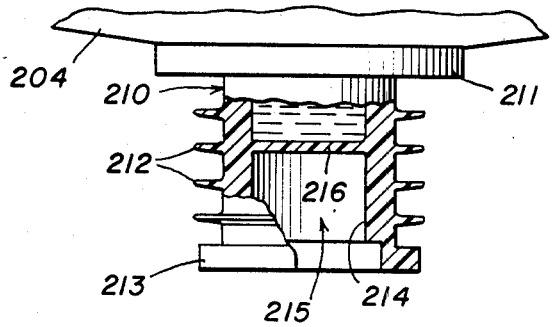

FIG. 7
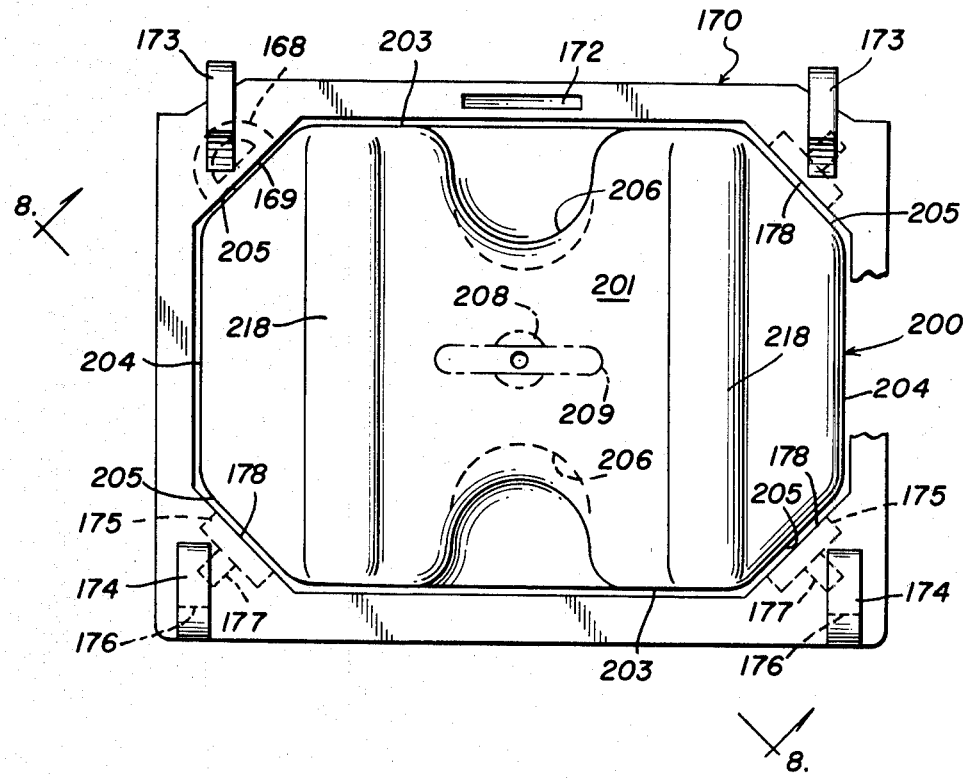
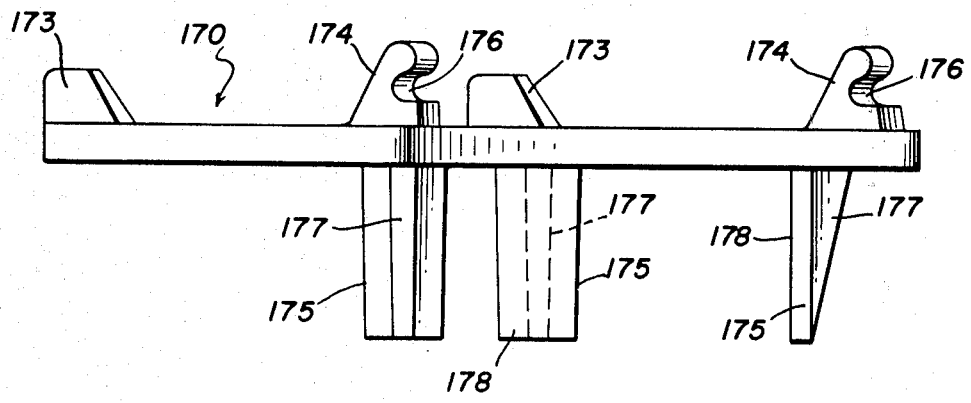
FIG. 8

SOAP DISPENSING SYSTEM

BACKGROUND OF THE INVENTION

The present invention relates to apparatus for dispensing liquid soap, normally in discrete small quantities or charges. Such dispensing apparatus is used, particularly for hygienic purposes, in public or institutional washrooms or the like or wherever there are a relatively large number of different users.

One such dispenser is disclosed in my U.S. Pat. No. 4,149,573, assigned to the assignee of the present invention, and of which the present invention is an improvement. In the system of the 4,149,573 patent, a container is provided with a refill aperture which is dimensioned so that at equal pressures inside and outside said container liquid soap will flow therethrough only very slowly if at all. Thus, in refilling the container, a special squeeze-bottle type refill cartridge is used in order to force the soap through the refill aperture, the cartridge outlet being closed by a pierceable membrane which is ruptured by a piercing member adjacent to the refill aperture to permit the flow of liquid soap from the refill cartridge.

While this prior dispensing system works effectively, it has been found that an inconveniently long time is required for a serviceman to squeeze the contents of the refill cartridge into the reservoir of the dispenser. Generally quite a few squeezes of the refill cartridge are necessary in order completely to empty it, and if the serviceman does not completely empty the container, considerable soap wastage results.

Also, this prior system has the disadvantage of leaving the refill aperture and the piercing member exposed to the atmosphere and possible contamination by dust and the like between refills.

Furthermore, in the case of an opaque container, it is not possible readily to determine the amount of liquid soap left therein so as to know whether or not a refill is necessary.

Finally, the cylindrical refill cartridges are of an efficient shape for squeeze-bottle operation, but are inconvenient for storage since they entail a considerable amount of wasted space.

SUMMARY OF THE INVENTION

Therefore, it is a general object of this invention to provide a liquid soap dispensing system, which includes a refillable dispenser, and which avoids the disadvantages of prior art dispensing systems while affording additional structural and operating advantages.

It is another object of this invention to provide a soap dispensing system of the type set forth which accommodates free flow of liquid soap from the refill cartridge through the refill aperture into the soap reservoir of the container.

Still another object of this invention is the provision of a liquid soap dispensing system of the type set forth, wherein the refill operation requires very little of a serviceman's time.

Another object of this invention is the provision of a liquid soap dispensing system which includes a refillable liquid soap container having a refill compartment therein in which a refill cartridge may be enclosed and left in place.

Yet another object of this invention is the provision of a liquid soap dispensing system of the type set forth which is adapted only for use with a specially designed refill cartridge.

In connection with the foregoing object, it is another object of this invention to provide a liquid soap dispensing system of the type set forth, which includes means for effectively preventing the accumulation of free liquid soap in the refill compartment.

It is another object of this invention to provide means for accurately guiding and positioning the refill cartridge in the refill compartment.

It is another object of this invention to provide a refillable liquid soap container for use in a system of the type set forth.

Yet another object of this invention is the provision of a refill cartridge uniquely designed for use with a system of the type set forth.

In connection with the foregoing object, it is another object of this invention to provide a refill cartridge which includes vent means to facilitate the free flow of liquid soap therefrom.

In connection with the foregoing object, still another object of this invention is the provision of a refill cartridge having a removable cap which covers a vent aperture until after the cartridge is installed in a dispenser.

These and other objects of the present invention are achieved in a system for dispensing liquid soap comprising a closed wall structure defining a container, partition means separating the container into a lower liquid soap reservoir and an upper refill compartment, dispensing means carried by the container for dispensing liquid soap from the reservoir, the partition means having a refill aperture therethrough providing communication between the reservoir and the refill compartment and dimensioned to permit the free flow of liquid soap therethrough, and a refill cartridge containing liquid soap and having an outlet, the refill cartridge being removably enclosed within the refill compartment in a refill configuration with the outlet disposed for cooperation with the refill aperture to permit the free flow of liquid soap from the refill cartridge to the reservoir thereby to refill the reservoir as liquid soap is dispensed therefrom.

Further features of the invention pertain to the particular arrangement of the parts of the liquid soap dispensing system whereby the above-outlined and additional operating features thereof are attained.

The invention, both as to its organization and method of operation, together with further objects and advantages thereof, will best be understood by reference to the following specification taken in connection with the accompanying drawings.

BRIEF DESCRIPTION OF THE DRAWINGS

FIG. 3 is a view in vertical section taken along the line 3—3 in FIG. 2, and illustrating the internal construction of the soap dispenser;

FIG. 4 is an enlarged fragmentary elevational view in partial vertical section of the outlet neck of the refill cartridge of the present invention;

FIG. 7 is a top plan view of the system as illustrated in FIG. 5; and

FIG. 8 is an elevational view of the top plate of the dispenser, taken generally in the direction of the arrows 8—8 in FIG. 7.

DESCRIPTION OF THE PREFERRED EMBODIMENT

Figure 1:
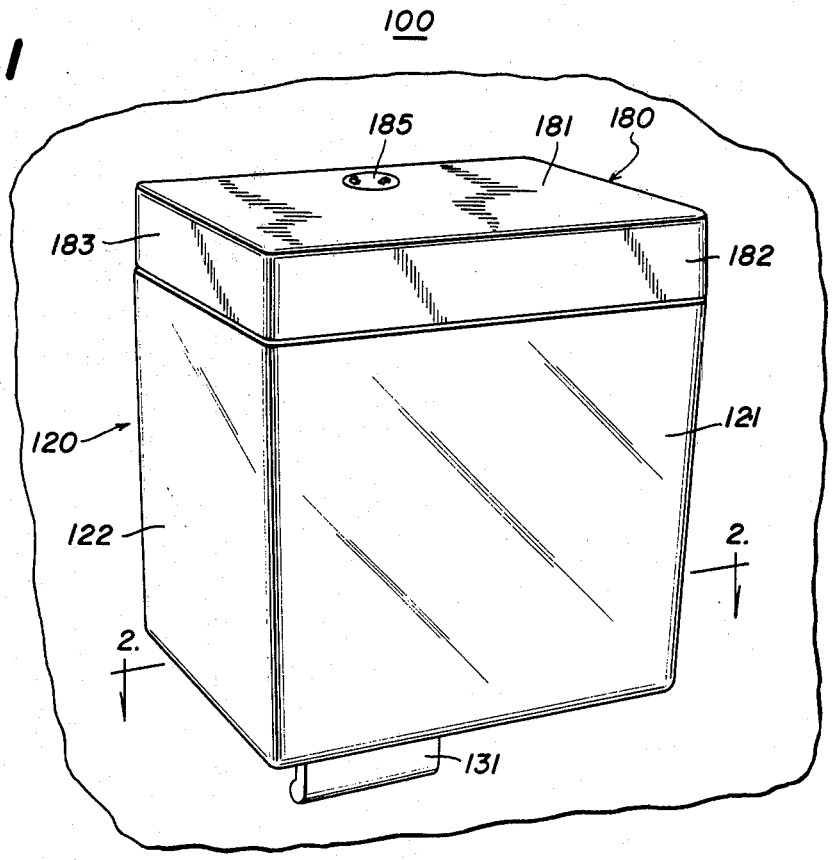
FIG. 1 is a front perspective view of a liquid soap dispenser constructed in accordance with and embodying the features of the present invention.
Figure 2:
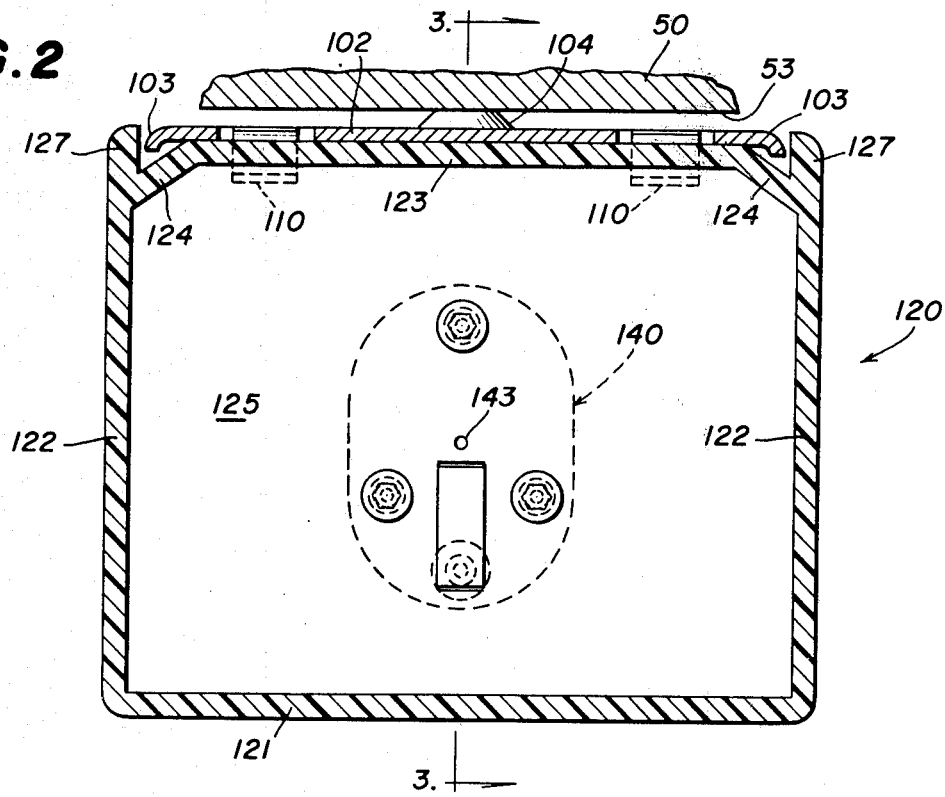
FIG. 2 is an enlarged view in horizontal section taken along the line 2—2 in FIG. 1.
Figure 5:
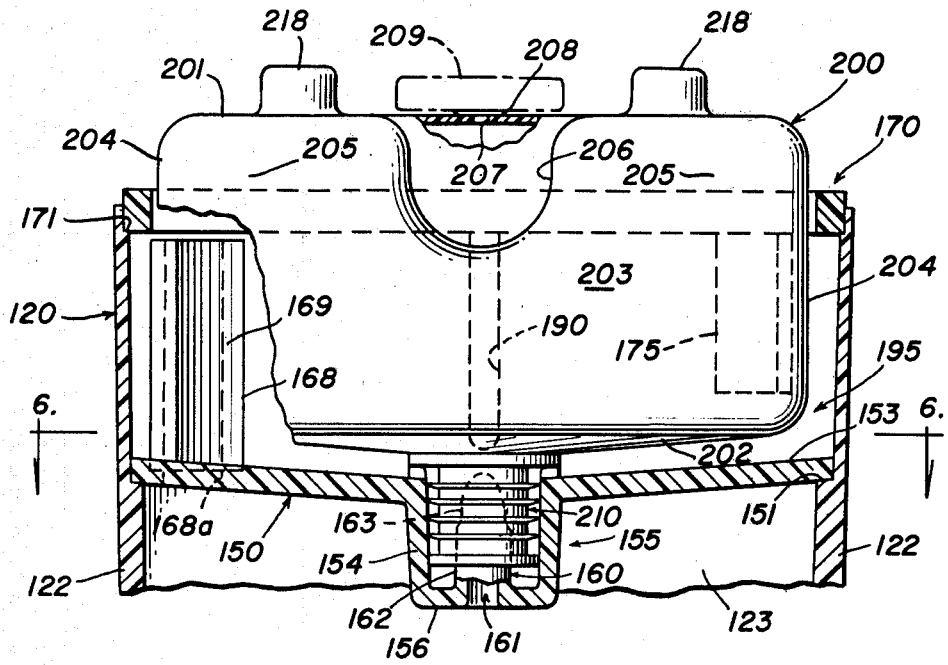
FIG. 5 is a fragmentary view in vertical section taken along the line 5—5 in FIG. 3, with the cover plate of the dispenser removed.
Figure 6:
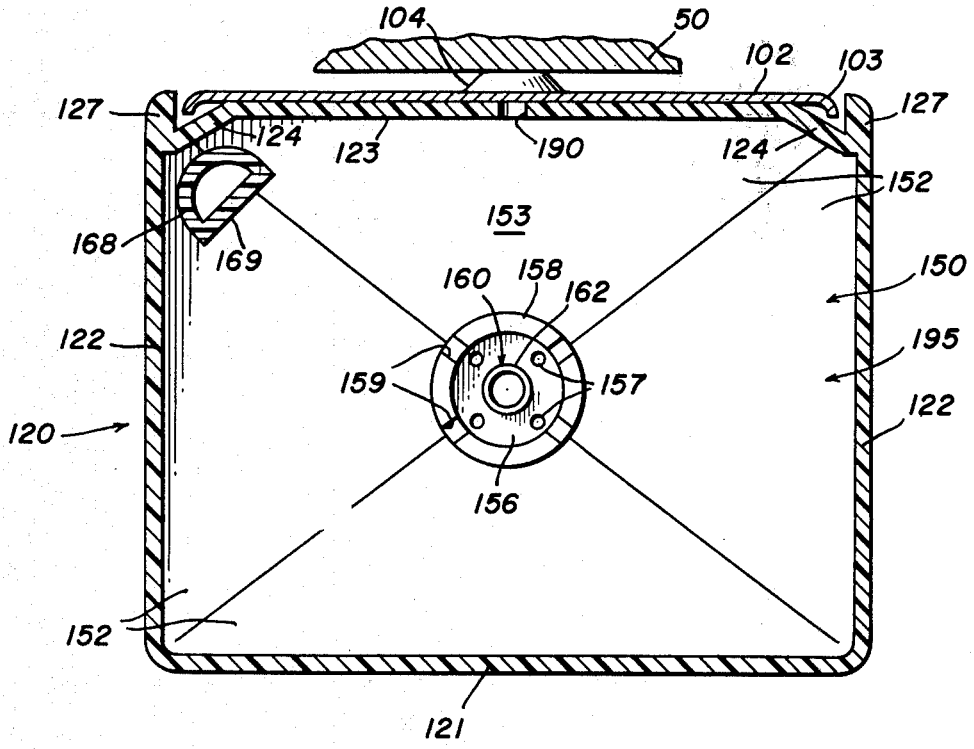
FIG. 6 is a view in horizontal section taken along the line 6—6 in FIG. 5.

Referring now to FIGS. 1 through 3 of the drawings, there is illustrated a soap dispenser, generally designated by the numeral 100, constructed in accordance with and embodying the features of the present invention. The soap dispenser 100 includes a mounting bracket, generally designated by the numeral 101, which includes a generally flat rectangular wall 102 disposed substantially vertically in use to provide a bearing surface, and having along each of the side edges thereof an integral curved side flange 103 which projects forwardly from the wall 102. Formed in the vertical wall 102 and projecting rearwardly therefrom in a direction away from the direction in which the side flanges 103 extend, are two substantially vertically aligned embossments 104, each having an opening 105 extending therethrough centrally thereof. Also formed in the wall 102 and projecting rearwardly therefrom are two embossments 106 (one shown) which are disposed substantially in horizontal alignment with each other along a line disposed substantially midway between the embossments 104, with the embossments 106 projecting the same distance as the embossments 104, and each having an opening (not shown) extending therethrough centrally thereof.

Integral with the wall 102 at the upper end thereof is an extension flange 108 which is inclined forwardly in the same general direction as the side flanges 103, and which is integral at the distal end thereof with an upwardly extending flange 109 which is substantially parallel to the wall 102. Punched from the wall 102 adjacent to the lower end thereof are two forwardly and upwardly extending support fingers 110.

Integral with the bottom end of the wall 102 and extending forwardly therefrom substantially normal thereto is a wall 111 which is disposed substantially horizontally in use and is provided around the periphery thereof with an integral upturned flange 112, which is in turn integral with the side flanges 103. Integral with the wall 111 and projecting upwardly therefrom substantially normal thereto are two parallel and laterally spaced-apart pivot brackets 113, a portion of the wall 111 between the pivot brackets 113 being cut out to define a generally rectangular opening 114. Formed in the wall 111 adjacent to the forward edge thereof and substantially midway between the side edges thereof is a circular soap discharge opening 115, the purpose of the openings 114 and 115 being described more fully below. A circular retaining plate 118 is pivotally secured to the inner surface of the upwardly extending flange 109 as by a rivet 119.

In use, the mounting bracket 101 is mounted on a wall 50, generally above and closely adjacent to a sink or washbasin or the like. Mounting openings or holes 51 are formed in the wall 50 and may have screw fastening inserts 52 set therein. The mounting bracket 101 is fixedly secured to the wall 50 by means of mounting screws 55 which are passed through the openings in the embossments 104 or 106 and threadedly engaged in the inserts 52, the wall 102 being disposed substantially parallel to the surface 53 of the wall 50, and being in contact therewith only at the embossments 104 and 106, which serve to space the mounting bracket 101 a slight distance from the surface 53 of the wall 50.

The dispenser 100 also includes a soap container or housing, generally designated by the numeral 120, which is preferably formed of a translucent or transparent plastic, although it will be understood that any suitable material, either opaque or light-transmitting, could be used. The container 120 is generally box-like in configuration and includes a generally rectangular front wall 121, a pair of opposed side walls 122, a rear wall 123 and a rectangular bottom wall 125, the container 120 preferably being molded so that the walls 121, 122, 123 and 125 are all formed integrally with one another. The rear wall 123 is provided at the lateral side edges thereof with inturned forwardly inclined portions 124. The side walls 122 have rearwardly extending portions 127 which project rearwardly beyond the rear wall 123, whereby the rear wall 123 is recessed with respect to the side walls 122. In addition, the rear wall 123 extends downwardly below the bottom wall 125 to form a downwardly extending portion or mounting flange 128. Similarly, the front wall 121 and the side walls 122 all extend downwardly well below the bottom wall 125 and below the bottom edge of the mounting flange 128 to form a skirt 129.

Mounted below the bottom wall 125 of the container 120 is a pump assembly, generally designated by the numeral 130. The operation and construction of the pump assembly 130 is described in detail in my U.S. Pat. No. 4,018,363, issued Apr. 19, 1977, and assigned to the assignee of the present invention, the disclosure of which patent is incorporated herein by reference. The pump assembly 130 includes an operating handle 131 provided with a pivot pin 132, the opposite ends of which are respectively mounted in the pivot brackets 113 on the mounting bracket wall 111 for pivotal movement of the operating handle 131 about the axis of the pivot pin 132, which extends substantially horizontally above the bracket wall 111 substantially parallel thereto and to the bracket wall 102. The handle 131 projects in use downwardly through the opening 114 in the bracket wall 111 and terminates at the lower end thereof in an enlarged gripping portion. The handle 131 also includes a stop member 134 which projects rearwardly from the pin 132 above the housing wall 111, and an actuating arm 135 which projects forwardly from the pin 132 above the bracket wall 111 and is substantially longer than the stop member 134.

The pump assembly 130 also includes a unitary pump housing 140, which is preferably of molded construction. The pump housing 140 is fixedly secured to the bottom wall 125 of the container 120 by suitable fasteners. Securely sandwiched between the pump housing 140 and the bottom wall 125 of the container 120 is a flexible diaphragm 141 having a plurality of suction apertures therethrough in surrounding relationship with a suction conduit or opening 143 in the bottom wall 135 of the container 120. The diaphragm 141 also has a plurality of discharge apertures therein disposed in surrounding relationship with a discharge conduit 144 in the bottom wall 125. A flexible resilient bowl 145 is disposed below the diaphragm 141 in the region of the suction conduit 143, the outer surface of the bowl 145 normally just touching the actuating arm 135 when the handle 131 is in its normal rest position illustrated in FIG. 3. Disposed below the diaphragm 141 in the region of the discharge conduit 144 is a delivery conduit 146 in a spout 147 disposed immediately above and in alignment with the soap discharge opening 115 in the mounting bracket wall 111. A channel provides communication between the bowl 145 and the discharge conduit 144.

In operation, the soap container 120 is mounted on the mounting bracket 101 in a manner which is fully explained in my aforementioned U.S. Pat. No. 4,149,573, the disclosure of which is incorporated herein by reference. The operating handle 131 is pulled forwardly by a user thereby to compress the bowl 145 with the actuating arm 135 and expel a predetermined quantity of liquid soap from the delivery conduit 146, release of the operating handle 131 permitting re-expansion of the bowl 145 thereby to suck a fresh charge of liquid soap from the container 120 through the suction conduit 143 in preparation for the next dispensing operation, all as is more fully explained in my aforementioned U.S. Pat. Nos. 4,018,363 and 4,149,573.

It is an important feature of this invention that there is provided in the soap container 120 a partition, generally designated by the numeral 150, which is disposed generally horizontally in use, the partition 150 being substantially rectangular in shape with the peripheral edges thereof resting upon a ledge 151 formed in the inner surfaces of the soap container walls 121–123 and fixedly secured thereto as by ultrasonic welding. The partition 150 comprises four generally triangular sectors 152, the upper surfaces 153 of which slope gently downwardly toward the center of the partition 150 at which there is formed a well, generally designated by the numeral 155. The well 155 includes a cylindrical side wall 154 integral at the upper end thereof with the partition 150 and extending downwardly therebelow, the lower end thereof being terminated by a circular bottom wall 156. Formed in the bottom wall 156 adjacent to the outer edge thereof are four equiangularly spaced-apart small drain holes 157. Integral with the upper surface 153 of the partition 150 around the upper perimeter of the well 155 is an annular rim 158 having notches 159 formed therein respectively at the junctions of the triangular sectors 152.

Integral with the bottom wall 156 of the well 155 and extending upwardly therefrom centrally thereof and coaxially with the cylindrical side wall 154 is a hollow tubular piercing member, generally designated by the numeral 160. The lower end of the piercing member 160 surrounds a complementary opening in the bottom wall 156 and cooperates therewith to define a refill passage or aperture 161 through the well 155. The outer surface 162 of the piercing member 160 has a reduced diameter upper portion 163, the piercing member 160 having a beveled tip 164 at its upper end, the upper edge of which extends a slight distance upwardly above the annular rim 158 and presents a sharp piercing edge.

It can be seen that the partition 150 cooperates with the bottom wall 125 and the walls 121–123 of the container 120 to define therebetween a liquid soap reservoir, generally designated by the numeral 165, which is adapted to be filled with a quantity of liquid soap 166 to a level 167, the position of the partition 150 in the soap container 120 being such that the reservoir 165 occupies slightly less than half the interior volume of the container 120. Fixedly secured to the partition 150 adjacent to one corner thereof and extending vertically upwardly therefrom and terminating adjacent to the upper end of the container 120 is a hollow vent tube 168, the lower end of which communicates with a vent opening **168*a* formed through the partition 150. The vent tube 168 is generally semicircular in transverse cross section and has a flat rectangular retaining surface 169 thereon facing inwardly toward the well 155 and disposed generally at a 45°-angle to the rear wall 123 and the adjacent side wall 122**.

The container 120 is also provided with a top plate, generally designated by the numeral 170, the outer perimeter of which conforms to the perimeter of the upper edge of the container 120 and is adapted to be seated on a ledge 171 formed in the inner surfaces of the container walls 121–123 and fixedly secured thereto as by ultrasonic welding. The top plate 170 has a large octagonal opening formed therein so that the top plate 170 essentially comprises a relatively narrow flange projecting horizontally inwardly from the walls of the container 120. Formed in the upper surface of the top plate 170 adjacent to the rear edge thereof is a shallow recess 172 adapted to receive therein the retaining plate 118 fixedly to hold the container 120 in place on the mounting bracket 101. Extending upwardly from the top plate 170 at the rear corners thereof are two rear abutments 173, while two forward abutments 174 respectively extend upwardly from the top plate 170 adjacent to the front corners thereof, the forward abutments 174 each having a notch 176 formed in the front surface thereof.

Four of the edges of the octagonal inner perimeter of the top plate 170 extend across the corners of the container 120 substantially at 45°-angles to the adjacent walls thereof, one of these corner edges being substantially coplanar with the guide surface 169 of the vent tube 168. Integral with the top plate 170 respectively adjacent to the other three corner edges and extending downwardly therefrom are three positioning members 175, each having a stiffening rib 177 along the outer surface thereof, and each being provided with an inner flat rectangular guide surface 178. The guide surfaces 178 are all disposed substantially vertically and face inwardly toward the well 175, and are respectively substantially coplanar with the adjacent corner edges of the top plate 170.

The container 120 is also provided with a cover plate, generally designated by the numeral 180, which includes a flat rectangular top wall 181, a front wall 182, a pair of opposed side walls 183 and a rear wall 184, all integrally connected in a unitary structure. Fixedly secured to the top wall 181 adjacent to the rear edge thereof is a key-operated latch mechanism 185. Fixedly secured to the inner surface of the front wall 182 is an elongated bearing plate 186 provided at the opposite ends thereof with rearwardly extending fingers 187, each preferably covered with a resilient cushioning material, the fingers 187 being respectively adapted to be received in the notches 176 in the forward abutments 174 of the top plate 170. The cover plate 180 is dimensioned so as completely to cover the top wall 170 of the container 120, with the walls 182–184 having a vertical extent sufficient to accommodate the inclined flange 108 and the upwardly extending flange 109 of the mounting bracket 101. In use, the fingers 187 are inserted into the notches 176 of the forward abutments 174, and the cover plate 180 is then pivoted down into position completely covering the top of the container 120, as illustrated in FIG. 3, a latch hook of the latch mechanism 185 engaging in a complementary keeper opening (not shown) in the upwardly extending flange 109 of the mounting bracket 101.

Formed in the rear wall 123 of the container 120 is a vertical slot 190 which extends from just above the partition 150 to the top wall 170, for a purpose to be explained more fully below. It can be seen that the cover plate 180 cooperates with the partition 150 and the walls 121–123 of the container 120 to define a closed refill compartment, generally designated by the numeral 195, communication between the refill compartment 195 and the liquid soap reservoir 165 being provided by the refill aperture 161 through the hollow piercing member 160, and by the hollow vent tube 168 and vent opening 168*a*.

The soap dispensing system of the present invention also includes a refill cartridge, generally designated by the numeral 200, which is semirigid and preferably formed of a translucent soft plastic material, and is adapted to hold a supply of liquid soap for refilling the liquid soap reservoir 165 of the container 120. The refill cartridge 200 is generally in the shape of a polyhedron having top and bottom walls 201 and 202 interconnected by a pair of opposed side walls 203 and a pair of opposed end walls 204, the side walls 203 and the end walls 204 being generally perpendicular to each other and to the top and bottom walls 201 and 202. Connecting the side walls 203 to the end walls 204 and inclined substantially at 45°-angles to each are four guide or corner walls 205, each of which is also perpendicular to the top and bottom walls 201 and 202. Formed at the junctions of the top wall 201 with the side walls 203 intermediate the ends thereof are two indentations or recesses 206 for receiving the fingers of a user. Formed in the top wall 201 centrally thereof is a vent aperture 207 surrounded by an upwardly extending septum or membrane 208, which is in turn connected to and closed by a cap 209 in the form of a knob or handle.

Integral with the bottom wall 202 and projecting outwardly therefrom centrally thereof is a cylindrical neck 210 having at the upper end thereof an annular base rim 211 by which it is coupled to the bottom wall 201. Extending circumferentially around the neck 210 and projecting radially outwardly therefrom are a plurality of longitudinally spaced-apart annular ribs or flanges 212. The neck 210 terminates at a thickened annular outer end 213. The neck 210 has a cylindrical inner surface 214 which defines an outlet passage 215 therethrough communicating with the interior of the refill cartridge 200, the outlet passage 215 being closed by a membrane 216 disposed substantially midway between the ends of the neck 210. Integral with the top wall 201 and projecting upwardly therefrom at least as far as the cap 209 are two elongated ribs 218 which are respectively disposed on opposite sides of the cap 209 and extend between the side walls 203 substantially normal thereto.

When it is desired to refill the liquid soap reservoir 165 of the container 120, the cover plate 180 is unlocked and removed and a new refill cartridge 200 is inserted into the refill compartment 195. The refill cartridge 200 is shaped and dimensioned to just fit within the octagonal opening defined by the top plate 170, with the guide walls 205 of the refill cartridge 200 being respectively disposed for sliding engagement with the guide surfaces 178 of the positioning members 175 and the guide surface 169 of the vent tube 168, these guide surfaces cooperating accurately to guide the neck 210 of the refill cartridge 200 into the well 155. The neck 210 is dimensioned to fit within the well 155 with the annular flanges 212 disposed in flexible sealing engagement with the inner surface of the cylindrical side wall 154, and with the piercing member 160 extending upwardly into the outlet passage 215 of the neck 210.

More particularly, it will be appreciated that the reduced diameter upper portion 163 of the outer surface of the piercing member 160 facilitates entry thereof into the outlet passage 215, the remainder of the outer surface 162 of the piercing member 160 being dimensioned snugly to fit against the inner surface 214 of the neck 210. The refill cartridge 200 is forced downwardly to a refill configuration wherein the outer end 213 of the neck 210 bottoms on the bottom wall 156 of the well 155, thereby driving the piercing member 160 through the membrane 216 rupturing same and permitting free flow of liquid soap from the refill cartridge 200 through the refill passage 161 and into the liquid soap reservoir 165. When the refill cartridge 200 has thus been inserted into its refill configuration in the refill compartment 195, the cap 209 is twisted off for breaking the membrane 208 and opening the vent aperture 207, thereby to equalize the pressure inside and outside said refill cartridge. The cover plate 180 is then locked back in place to close the refill compartment 195 and enclose the refill cartridge 200 therein. It will be appreciated that the entire cartridge replacement operation can be performed in a matter of seconds.

When the next service call is made, the serviceman can immediately tell from inspection of the translucent refill cartridge 200 whether or not it is empty. If it is empty, it is removed and discarded and a new refill cartridge 200 is inserted into its place in the manner described above. If the refill cartridge 200 is not empty, then the serviceman knows that the reservoir 165 is still substantially full and that no further refill is needed.

It will be appreciated that the dimensions of the outlet passage 215 of the refill cartridge 200 and the refill passage 161 of the piercing member 160 are such as readily to permit the free flow of liquid soap therethrough by gravity, without any necessity for squeezing the refill cartridge 200 or otherwise placing the contents thereof under greater than ambient pressure. Thus, the contents of the refill cartridge 200 will flow into the liquid soap reservoir 165 until the latter is substantially filled or until the cartridge 200 is empty. When the liquid soap reservoir 165 is filled, liquid soap will then gradually continue to flow thereinto from the cartridge 200 to replace liquid soap as it is dispensed from the reservoir 165.

It is an important feature of the present invention that the vent tube 168 and the vent opening 168*a* serve to equalize the pressure inside and outside the liquid soap reservoir 165 to facilitate the dispensing of soap therefrom. This separate venting of the reservoir 165 insures operation of the system even in the event that the serviceman inserting the refill cartridge 200 forgets to remove the cap 209 and open the vent aperture 207. In that case, when the level of soap in the reservoir 165 falls below the bottom of the well 155, liquid soap will begin to flow through the refill passage 161 by gravity and, at the same time, small quantities of air will pass upwardly through the refill passage 161 into the refill cartridge 200 to maintain the pressure therein. While the emptying of the refill cartridge 200 under this arrangement will be slower and less efficient than if the vent aperture 207 were open, it will be at a sufficient rate to replace the liquid soap in the reservoir 165 as it is dispensed therefrom.

It is another important feature of the present invention that the soap dispenser 100 is usable only with the refill cartridge 200 specifically designed therefor, so that the container 120 cannot be refilled with liquid soap from an unauthorized source. This purpose is furthered by the slot 190 in the rear wall 123 of the container 120. More particularly, it will be understood that by reason of the large dimensions of the refill passage 161 which permit free flow of liquid soap therethrough by gravity under ambient pressure, there would be a temptation for unauthorized purveyors of liquid soap to simply pour free or bulk liquid soap into the refill compartment 195 and let it drain through the refill passage 161. If this is attempted, however, the soap will immediately also flow out through the slot 190, running down the back of the container 100, onto the bracket wall 111 and along the outside of the pump assembly 130 creating a messy overflow and possibly fouling the dispensing mechanism. Thus, it will be appreciated that the slot 190 effectively prevents the accumulation of free liquid soap in the reservoir 165.

If, however, during replacement of the refill cartridge 200 some small quantities of liquid soap drip onto the partition 150, they will flow into the well 155 through the notches 159 in the annular rim 158 by reason of the sloping upper surface 153 of the partition 150. The soap will then gradually drain through the small drain holes 157 into the reservoir 165.

It will be noted that the finger recesses 206 in the refill cartridge 200 serve to facilitate handling thereof during insertion into and removal from the refill compartment 195. These recesses are particularly useful in removal of the spent refill cartridge 200 because of the very close fit between the walls of the cartridge 200 and the top plate 170 and because, when fully inserted into its refill configuration, the refill cartridge 200 only extends a slight distance above the top plate 170.

In storage of the refill cartridge 200 it is generally preferably to dispose the top wall 201 downward, since this affords a more stable base than does the neck 210. It will be appreciated that the ribs 218 provide bearing surfaces for supporting the refill cartridge 200 thereon during storage, these ribs 218 serving to prevent contact of the cap 209 with the underlying support surface or adjacent objects, thereby helping to prevent the cap 209 from accidentally being knocked off with resultant leakage of the liquid soap through the vent aperture 207. Similarly, it will be appreciated that the recessed position of the membrane 216 well within the neck 210 serves to minimize the chance of accidental rupture thereof during storage or handling.

From the foregoing, it can be seen that there has been provided an improved soap dispensing system which includes a refillable liquid soap dispenser and a refill cartridge therefor, such that there is permitted rapid servicing of the dispenser for refill thereof, while at the same time effectively preventing refilling of the container with soap from an unauthorized source.

There has also been provided an improved soap dispensing system of the character described, which permits the serviceman readily to determine by observation whether or not refill of the dispenser is needed, even in the case of an opaque dispenser.

What is claimed is:

1. A system for dispensing liquid soap comprising a closed wall structure defining a container, partition means separating said container into a separate lower liquid soap reservoir and a separate upper refill compartment, dispensing means carried by said container for dispensing liquid soap from said reservoir, said partition means having a refill aperture therethrough providing the exclusive communication for soap flow between said reservoir and said refill compartment and dimensioned to permit the free flow of liquid soap therethrough, and a refill cartridge containing liquid soap and having an outlet, said refill cartridge being removably enclosed within said refill compartment in a refill configuration with said outlet disposed for cooperation with said refill aperture to permit the free flow of liquid soap from said refill cartridge to said reservoir thereby to refill said reservoir as liquid soap is dispensed therefrom.

2. The system of claim 1, wherein said refill aperture is disposed substantially centrally of said partition means, said partition means having an upper surface sloping inwardly toward said refill aperture.

3. The system of claim 1, and further including a vent opening formed in said partition means for equalizing the pressure in said reservoir and said refill compartment when said cartridge is disposed in said refill configuration.

4. A system for dispensing liquid soap comprising a closed wall structure defining a container, partition means separating said container into a separate lower liquid soap reservoir and a separate upper refill compartment, dispensing means carried by said container for dispensing liquid soap from said reservoir, first coupling means carried by said partition means and defining a refill aperture therethrough providing the exclusive communication for soap flow between said reservoir and said refill compartment and dimensioned to permit the free flow of liquid soap therethrough, a refill cartridge containing liquid soap and having second coupling means thereon forming a discharge outlet, and vent means for equalizing the pressure inside and outside said refill cartridge to facilitate the flow of liquid soap from said discharge outlet, said refill cartridge being removably enclosed within said refill compartment in a refill configuration with said first and second coupling means disposed in coupled relationship for cooperation to hold said outlet and said refill aperture in registration to permit the free flow of liquid soap therethrough from said refill cartridge to said reservoir thereby to refill said reservoir as liquid soap is dispensed therefrom while preventing the flow of liquid soap into said refill compartment, said wall structure having an opening therein above said partition means for permitting flow of liquid soap therethrough thereby to prevent the accumulation of free liquid soap in said refill compartment.

5. The system of claim 4, wherein said opening in said wall structure comprises a vertical slot extending upwardly from adjacent to said partition means.

6. The system of claim 4, wherein said first coupling means includes a piercing member disposed adjacent to said refill aperture and projecting upwardly therefrom, said second coupling means being dimensioned and adapted completely to encircle said piercing member and said refill aperture, said second coupling means including a membrane normally closing said outlet and adapted to be pierced by said piercing member when said cartridge is in said refill configuration to permit the flow of liquid soap from said cartridge through said refill aperture.

7. The system of claim 4, wherein said first coupling means includes a recessed portion of said partition means forming a well, said refill aperture being disposed at the bottom of said well, said second coupling means including a cylindrical neck defining said outlet and adapted to be received in said well in surrounding relationship with said refill aperture.

8. The system of claim 4, wherein said vent means includes a vent opening in said partition means.

9. The system of claim 4, wherein said vent means includes a vent aperture in said refill cartridge.

10. A system for dispensing liquid soap comprising a closed wall structure defining a container, partition means separating said container into a separate lower liquid soap reservoir and a separate upper refill compartment, dispensing means carried by said container for dispensing liquid soap from said reservoir, said partition means having a refill aperture therethrough providing the exclusive communication for soap flow between said reservoir and said refill compartment and dimensioned to permit the free flow of liquid soap therethrough, positioning means carried by said wall structure and disposed in said upper refill compartment, and a refill cartridge containing liquid soap and having an outlet, said refill cartridge being removably enclosed within said refill compartment in a refill configuration with said outlet disposed for cooperation with said refill aperture to permit the free flow of liquid soap from said refill cartridge to said reservoir thereby to refill said reservoir as liquid soap is dispensed therefrom, said refill cartridge having guide surfaces thereon disposable in engagement with said positioning means effectively to guide said cartridge to and from said refill configuration and prevent lateral movement thereof in said refill compartment.

11. The system of claim 10, wherein said positioning means comprises four positioning members respectively disposed at the corners of a rectangular configuration, said cartridge being generally in the shape of a polyhedron having four planar guide surfaces respectively engageable with said positioning members.

12. The system of claim 10, wherein said wall structure includes a peripheral flange extending inwardly of said refill compartment adjacent to the upper end thereof, said positioning means including a plurality of positioning members depending from said flange.

13. The system of claim 10, wherein said partition means has a vent opening therein to equalize the pressure inside and outside said reservoir when said cartridge is disposed in said refill configuration.

14. The system of claim 10, wherein said refill cartridge has a vent aperture therein opposite said outlet for equalizing the pressure inside and outside said cartridge thereby to facilitate the flow of liquid soap therefrom through said outlet, and further including cap means removably attached to said cartridge and normally closing said aperture to prevent accidental escape of liquid soap through said vent aperture during storage or handling of said cartridge.

15. A system for dispensing liquid soap comprising a closed wall structure defining a container, partition means separating said container into a separate lower liquid soap reservoir and a separate upper refill compartment, dispensing means carried by said container for dispensing liquid soap from said reservoir, first coupling means carried by said partition means and defining a refill aperture therethrough providing the exclusive communication for soap flow between said reservoir and said refill compartment and dimensioned to permit the free flow of liquid soap therethrough, positioning means carried by said wall structure and disposed in said upper refill compartment, a refill cartridge containing liquid soap and having second coupling means thereon forming a discharge outlet, and vent means for equalizing the pressure inside and outside said refill cartridge to facilitate the flow of liquid soap from said discharge outlet, said refill cartridge being removably enclosed within said refill compartment in a refill configuration with said first and second coupling means disposed in coupled relationship for cooperation to hold said outlet and said refill aperture in registration to permit the free flow of liquid soap therethrough from said refill cartridge to said reservoir thereby to refill said reservoir as liquid soap is dispensed therefrom while preventing the flow of liquid soap into said refill compartment, said refill cartridge having guide surfaces thereon disposable in engagement with said positioning means effectively to guide said cartridge to and from said refill configuration and prevent lateral movement thereof in said refill compartment, said wall structure having an opening therein above said partition means for permitting flow of liquid soap therethrough thereby to prevent the accumulation of free liquid soap in said refill compartment.

16. The system of claim 15, wherein said first coupling means includes a recessed portion of said partition means forming a well projecting downwardly into said reservoir, said refill aperture being disposed at the bottom of said well, and a hollow piercing member disposed in surrounding relationship with said refill aperture and projecting upwardly therefrom, said second coupling means including a cylindrical neck defining said outlet and a membrane disposed within said neck and normally closing said outlet, said neck being received in said well with said hollow piercing member extending into said neck and piercing said membrane when said cartridge is disposed in said refill configuration.

17. The system of claim 15, wherein said partition means has a vent opening therein to equalize the pressure inside and outside said reservoir when said cartridge is disposed in said refill configuration, said positioning means including a tubular member secured to said partition means in surrounding relationship with said vent opening and extending upwardly therefrom for providing communication between the vent opening and the upper portion of said refill compartment.

18. A refillable liquid soap dispenser adapted for use with a soap refill cartridge containing liquid soap and having an outlet, said dispenser comprising a closed wall structure defining a container, partition means dividing the interior of said container into a separate lower liquid soap reservoir and a separate upper refill compartment, and dispensing means carried by said soap container for dispensing liquid soap from said container, said partition means having a refill aperture therethrough providing the exclusive communication for soap flow between said refill compartment and said reservoir and dimensioned readily to permit the flow of liquid soap from said refill compartment to said reservoir, said refill compartment being dimensioned to enclose the associated refill cartridge in a refill configuration with the outlet thereof disposed for cooperation with said refill aperture to permit the free flow of liquid soap from the refill cartridge to said reservoir thereby to refill said reservoir as liquid soap is dispensed therefrom.

19. The liquid soap dispenser of claim 18, wherein said refill aperture is disposed substantially centrally of said partition means, said partition means having an upper surface sloping inwardly toward said refill aperture.

20. The liquid soap dispenser of claim 18, and further including a vent opening formed in said partition means for equalizing the pressure inside and outside said reservoir when said cartridge is disposed in said refill configuration.

21. A refillable liquid soap dispenser adapted for use with a soap refill cartridge containing liquid soap and having coupling means thereon forming a discharge outlet, said dispenser comprising a closed wall structure defining a container, partition means dividing the interior of said container into a separate lower liquid soap reservoir and a separate upper refill compartment, dispensing means carried by said soap container for dispensing liquid soap from said container, and coupling structure carried by said partition means and defining a refill aperture therethrough providing the exclusive communication for soap flow between said reservoir and said refill compartment and dimensioned to permit the free flow of liquid soap therethrough, said refill compartment being dimensioned to enclose the associated refill cartridge in a refill configuration with said coupling structure disposed in coupled relationship with the associated coupling means for cooperation to hold the outlet thereof in registration with said refill aperture to permit the free flow of liquid soap therethrough from the associated refill cartridge to said reservoir thereby to refill said reservoir as liquid soap is dispensed therefrom while preventing the flow of liquid soap into said refill compartment, said wall structure having an opening therein above said partition means for permitting flow of liquid soap therethrough thereby to prevent the accumulation of free liquid soap in said refill compartment.

22. The liquid soap dispenser of claim 21, wherein said opening in said wall structure comprises a vertical slot extending upwardly from adjacent to said partition means.

23. The liquid soap dispenser of claim 21, wherein said first coupling means includes a piercing member disposed adjacent to said refill aperture and projecting upwardly therefrom and adapted for piercing a membrane closing the discharge outlet of the associated refill cartridge.

24. The liquid soap dispenser of claim 21, wherein said first coupling means includes a recessed portion of said partition means forming a well, said refill aperture being disposed at the bottom of said well.

25. The liquid soap dispenser of claim 21, wherein said partition means has a vent opening therein to equalize the pressure inside and outside said reservoir.

26. A refillable liquid soap dispenser adapted for use with a soap refill cartridge containing liquid soap and having guide surfaces thereon and a discharge outlet, said dispenser comprising a closed wall structure defining a container, partition means dividing the interior of said container into a separate lower liquid soap reservoir and a separate upper refill compartment, and dispensing means carried by said soap container for dispensing liquid soap from said container, said partition means having a refill aperture therethrough providing the exclusive communication for soap flow between said refill compartment and said reservoir and dimensioned readily to permit the flow of liquid soap from said refill compartment to said reservoir, said refill compartment being dimensioned to enclose the associated refill cartridge in a refill configuration with the outlet thereof disposed for cooperation with said refill aperture to permit the free flow of liquid soap from the refill cartridge to said reservoir thereby to refill said reservoir as liquid soap is dispensed therefrom, and positioning means carried by said wall structure and disposed in said upper refill compartment for engagement with the guide surfaces of the associated cartridge for guiding thereof to and from the refill configuration and to prevent lateral movement thereof in said refill compartment.

27. The liquid soap dispenser of claim 26, wherein said positioning means comprises four positioning members respectively disposed at the corners of a rectangular configuration.

28. The liquid soap dispenser of claim 26, wherein said wall structure includes a peripheral flange extending inwardly of said refill compartment adjacent to the upper end thereof, said positioning means including a plurality of positioning members depending from said flange.

29. The liquid soap dispenser of claim 26, wherein said partition means has a vent opening therein to equalize the pressure inside and outside said reservoir when the associated cartridge is disposed in its refill configuration, said positioning means including a tubular positioning member secured to said partition means in surrounding relationship with said vent opening and extending upwardly therefrom for providing communication between the vent opening and the upper portion of said refill compartment.

30. A refillable liquid soap dispenser adapted for use with a soap refill cartridge containing liquid soap and having thereon guide surfaces and coupling means forming a discharge outlet, said dispenser comprising a closed wall structure defining a container, partition means dividing the interior of said container into a separate lower liquid soap reservoir and a separate upper refill compartment, dispensing means carried by said soap container for dispensing liquid soap from said container, and coupling structure carried by said partition means and defining a refill aperture therethrough providing the exclusive communication for soap flow between said reservoir and said refill compartment and dimensioned to permit the free flow of liquid soap therethrough, said refill compartment being dimensioned to enclose the associated refill cartridge in a refill configuration with said coupling structure disposed in coupled relationship with the associated coupling means for cooperation to hold the outlet thereof in registration with said refill aperture to permit the free flow of liquid soap therethrough from the associated refill cartridge to said reservoir thereby to refill said reservoir as liquid soap is dispensed therefrom while preventing the flow of liquid soap into said refill compartment, said wall structure having an opening therein above said partition means for permitting flow of liquid soap therethrough thereby to prevent the accumulation of free liquid soap in said refill compartment, and positioning means carried by said wall structure and disposed in said upper refill compartment for engagement with the guide surfaces of the associated cartridge for guiding thereof to and from the refill configuration and to prevent lateral movement thereof in said refill compartment.

31. The liquid soap dispenser of claim 30, wherein said first coupling means includes a recessed portion of said partition means forming a well projecting downwardly into said reservoir, said refill aperture being disposed at the bottom of said well, and a hollow piercing member disposed in surrounding relationship with said refill aperture and projecting upwardly therefrom and adapted for piercing a membrane closing the discharge outlet of the associated refill cartridge.

32. The liquid soap dispenser of claim 30, and further including vent means for equalizing the pressure inside and outside said reservoir when the associated cartridge is disposed in its refill configuration.

33. The liquid soap dispenser of claim 30, wherein said partition means has a vent opening therein to equalize the pressure inside and outside said reservoir when the associated cartridge is disposed in its refill configuration, said positioning means including a tubular positioning member secured to said partition means in surrounding relationship with said opening and extending upwardly therefrom for providing communication between the vent opening and the upper portion of said refill compartment.

* * * * *

Disclaimer 4,345,627.—*Antonio M. Cassia,* Milan, Italy SOAP DISPENSING SYSTEM. Patent dated Aug. 24, 1982. Disclaimer filed Aug. 3, 1983, by the assignee, *Steiner Corp.*

Hereby enters this disclaimer to claims 1–33 of said patent.

[*Official Gazette February 28, 1984.*]